US009691569B2

(12) United States Patent
Chen

(10) Patent No.: US 9,691,569 B2
(45) Date of Patent: Jun. 27, 2017

(54) LIGHT-TRANSMISSIBLE KEYCAP AND MANUFACTURING METHOD THEREOF

(71) Applicant: DARFON ELECTRONICS CORP., Taoyuan (TW)

(72) Inventor: Shih-Kai Chen, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 166 days.

(21) Appl. No.: 14/859,352

(22) Filed: Sep. 20, 2015

(65) Prior Publication Data

US 2016/0086746 A1 Mar. 24, 2016

(30) Foreign Application Priority Data

Sep. 23, 2014 (TW) ..... 103132863 A

(51) Int. Cl.
*H01H 13/02* (2006.01)
*H01H 13/83* (2006.01)

(52) U.S. Cl.
CPC ..... *H01H 13/023* (2013.01); *H01H 13/83* (2013.01); *H01H 2013/026* (2013.01); *H01H 2219/03* (2013.01); *H01H 2219/034* (2013.01); *H01H 2219/064* (2013.01); *H01H 2229/002* (2013.01); *H01H 2229/006* (2013.01); *H01H 2229/02* (2013.01); *H01H 2233/07* (2013.01)

(58) Field of Classification Search
CPC ..... H01H 13/023; H01H 13/83; H01H 2219/064; H01H 2219/03; H01H 2219/034; H01H 2229/02; H01H 2229/002; H01H 2229/006; H01H 2013/07; H01H 2013/026
See application file for complete search history.

(56) References Cited

U.S. PATENT DOCUMENTS

| | | | |
|---|---|---|---|
| 2012/0145522 A1 | 6/2012 | Lee | |
| 2012/0211342 A1 | 8/2012 | Chen | |

FOREIGN PATENT DOCUMENTS

| | | | | |
|---|---|---|---|---|
| CA | 2744564 A1 * | 9/2012 | ..... | H01H 13/83 |
| CN | 202172038 U | 3/2012 | | |
| CN | 102420065 A | 4/2012 | | |
| CN | 104051170 A | 9/2014 | | |
| TW | M405001 U1 | 6/2011 | | |
| TW | M409514 U1 | 8/2011 | | |
| TW | M476993 U | 4/2014 | | |

* cited by examiner

*Primary Examiner* — David V Bruce
(74) *Attorney, Agent, or Firm* — Winston Hsu

(57) ABSTRACT

A light-transmissible keycap and the manufacturing method thereof are provided. The light-transmissible keycap has multiple light-transmissible symbol areas, and each light-transmissible symbol area has at least one character assigned with a color. Each light-transmissible symbol area is covered with only one light-transmissible color layer. Thus, when an external light is emitted from a light source beneath the keycap, the external light will only pass through one light-transmissible color layer covering that light-transmissible symbol area, and not pass through the light-transmissible color layer covering the other light-transmissible symbol area. Therefore, a bleeding problem due to multiple light-transmissible color layers overlapped and covering the same light-transmissible symbol area is avoided.

17 Claims, 7 Drawing Sheets

LIGHT-TRANSMISSIBLE KEYCAP AND MANUFACTURING METHOD THEREOF

BACKGROUND OF THE INVENTION

1. Field of the Invention

The present invention relates to a manufacturing method of a keyboard, and more particularly, to a light-transmissible keycap and a manufacturing method thereof.

2. Description of the Prior Art

Keyboards are one of indispensable peripheral equipment of computers for inputting instructions to computers. A keycap of a key switch on a keyboard is marked with symbols and characters according to its function, so as to allow users to identify and select the appropriate key switch for inputting instructions to the computer easily.

According to specifications of a conventional keyboard, a keycap is marked with symbols and characters of different input methods. As for a conventional non-luminous keyboard, symbols and characters of different input methods can be sprayed or stuck on the keycaps with different colors, so as to allow users to identify the keycaps easily.

When symbols and characters are sprayed on the keycaps, it is required to repeat the spraying process many times to represent symbols and characters of different input methods with different colors because there is only one color allowed at a time in each the spraying process, which increases manufacturing cost. When the symbols and characters are stuck on the keycaps, it is not required to execute a sticking process repeatedly, but the stickers on the keycaps are easy to fall off during a using process, which affects identification of the keycaps.

Besides, as for a conventional luminous keyboard, symbols and characters can be represented by different colors of light. However, conventional light-transmissible color layers disposed on a light-transmissible keycap interfere with each other and affect an actual color of light, such that colors corresponding to different input methods are distorted, which affects aesthetics and identification of the conventional keycap. That's called a bleeding problem. Therefore, there is a need to design a light-transmissible keycap to solve the bleeding problem as mentioned above.

SUMMARY OF THE INVENTION

The present invention is to provide a light-transmissible keycap and a manufacturing method thereof, so as to solve the drawbacks as mentioned above.

According to the claimed invention, a manufacturing method for a light-transmissible keycap is disclosed. The light-transmissible keycap includes a first light-transmissible symbol area and a second light-transmissible symbol area. The manufacturing method includes the following steps: S1: providing a light-transmissible keycap body having a first predetermined area and a second predetermined area, the first predetermined area enclosing the first light-transmissible symbol area, the second predetermined area enclosing the second light-transmissible symbol area; S2: disposing a first light-transmissible color layer on the light-transmissible keycap body, the first light-transmissible color layer covering at least the first predetermined area but not covering the second predetermined area, the first light-transmissible color layer having a first color; S3: disposing a first dark color layer on the first light-transmissible color layer, the first dark color layer covering at least the first predetermined area, but not covering the second predetermined area; S4: providing a second light-transmissible color layer covering both the first dark color layer and the second predetermined area, the second light-transmissible color layer having a second color, the first color being different from the second color; S5: providing a second dark color layer covering the second light-transmissible color layer; S6: removing part of the second dark color layer, part of the second light-transmissible color layer, and part of the first dark color layer to expose part of the first light-transmissible color layer corresponding to the first light-transmissible symbol area, so as to make the first light-transmissible symbol area emit the first color light when an external light passes through the light-transmissible keycap; and S7: removing part of the second dark color layer to expose the second light-transmissible color layer corresponding to the second light-transmissible symbol area, so as to make the second light-transmissible symbol area emit the second color light when the external light passes through the light-transmissible keycap.

According to the claim invention, a light-transmissible keycap having a first light-transmissible symbol area and a second light-transmissible symbol area is disclosed and includes a light-transmissible keycap body, a first light-transmissible color layer, a first dark color layer, a second light-transmissible color layer, and a second dark color layer. The light-transmissible keycap body has a first predetermined area and a second predetermined area. The first predetermined area encloses the first light-transmissible symbol area. The second predetermined area encloses the second light-transmissible symbol area. The first light-transmissible color layer is disposed on the light-transmissible keycap body. The first light-transmissible color layer covers at least the first predetermined area but does not cover the second predetermined area. The first light-transmissible color layer has a first color. The first dark color layer is disposed on the first light-transmissible color layer. The first dark color layer covers at least first predetermined area but does not cover the second predetermined area. The first dark color layer has a first hollow pattern corresponding to the first light-transmissible symbol area. The second light-transmissible color layer covers the first dark color layer and the second predetermined area. The second light-transmissible color layer has a second color. The first color is different from the second color. The second light-transmissible color layer has a second hollow pattern corresponding to the first light-transmissible symbol area and communicating with the first hollow pattern. The second dark color layer covers the second light-transmissible color layer. The second dark color layer has a third hollow pattern corresponding to the first light-transmissible symbol area and communicating with the second hollow pattern, so as to expose an outer surface of the first light-transmissible color layer through the first hollow pattern, the second hollow pattern, and the third hollow pattern, and the second dark color layer has a fourth hollow pattern corresponding to the second light-transmissible symbol area, so as to expose an outer surface of the second light-transmissible color layer through the fourth hollow pattern. When an external light passes through the light-transmissible keycap, the first light-transmissible symbol area emit a light with the first color and the second light-transmissible symbol area emit a light with the second color.

In summary, when the external light passes through the light-transmissible keycap of the present invention, the different light-transmissible symbol areas corresponding to different input methods display different colors, such that it is easy for users to identify the appropriate symbols or characters corresponding to the input methods. Furthermore, when the external light passes through the light-transmissible keycap, the light will pass through the different light-transmissible color layers individually, and the light passing through the light-transmissible color layer will not be affected by other light travelling from other light-transmissible color layers. Therefore, the colors corresponding to the different light-transmissible symbol areas are regular, which solves the bleeding problem of the light-transmissible keycap in the prior art.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back, " etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
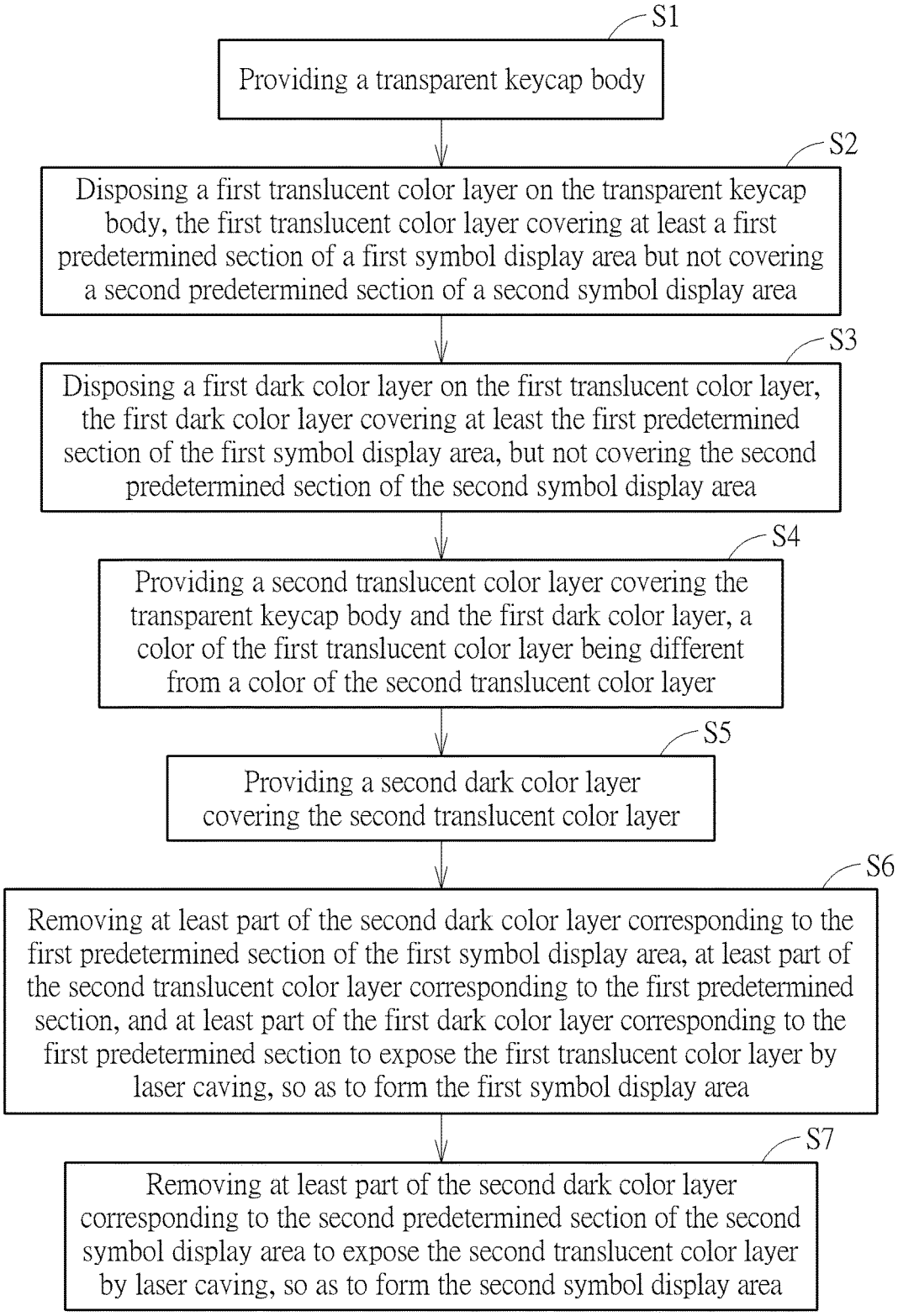
FIG. 1 is a flow chart of a manufacturing method of a light-transmissible keycap of the present invention.

Please refer to FIG. 1. FIG. 1 is a flow chart of a manufacturing method of a light-transmissible keycap of the present invention. As shown in FIG. 1, the manufacturing method of the light-transmissible keycap including a first light-transmissible symbol area and a second light-transmissible symbol area of the present invention includes the following steps:

S1: providing a light-transmissible keycap body, the light-transmissible keycap body having a first predetermined area and a second predetermined area, the first predetermined area enclosing the first light-transmissible symbol area, the second predetermined area enclosing the second light-transmissible symbol area;

S2: disposing a first light-transmissible color layer on the light-transmissible keycap body, the first light-transmissible color layer covering at least the first predetermined area but not covering a second predetermined area, the first light-transmissible color layer having a first color;

S3: disposing a first dark color layer on the first light-transmissible color layer, the first dark color layer covering at least the first predetermined area, but not covering the second predetermined area;

S4: providing a second light-transmissible color layer covering both the first dark color layer and the second predetermined area, the second light-transmissible color layer having a second color, the first color being different from the second color;

S5: providing a second dark color layer covering the second light-transmissible color layer;

S6: removing part of the second dark color layer, part of the second light-transmissible color layer, and part of the first dark color layer to expose the first light-transmissible color layer corresponding to the first light-transmissible symbol area, so as to make the first light-transmissible symbol area emit the first color light when an external light passes through the light-transmissible keycap; and S7: removing part of the second dark color layer to expose the second light-transmissible color layer corresponding to the second light-transmissible symbol area, so as to make the second light-transmissible symbol area emit the second color light when the external light passes through the light-transmissible keycap.

Figure 5:
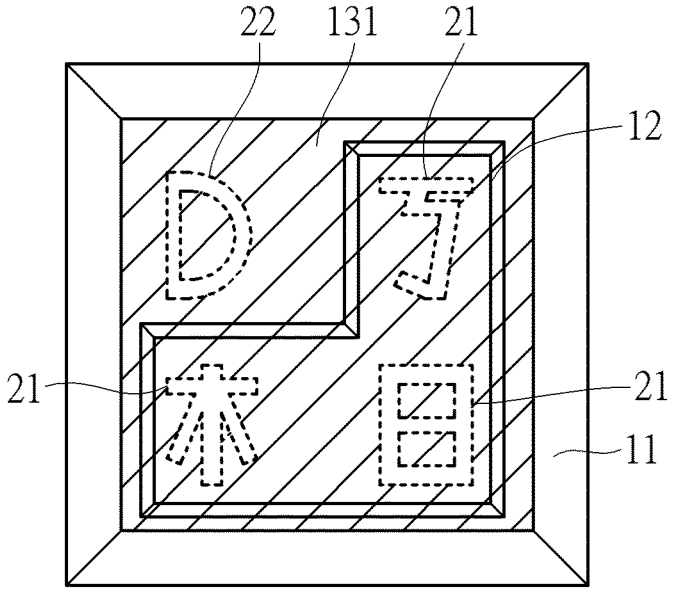
FIG. 5 is a top view diagram of the light-transmissible keycap according to the first embodiment of the present invention.
Figure 6:
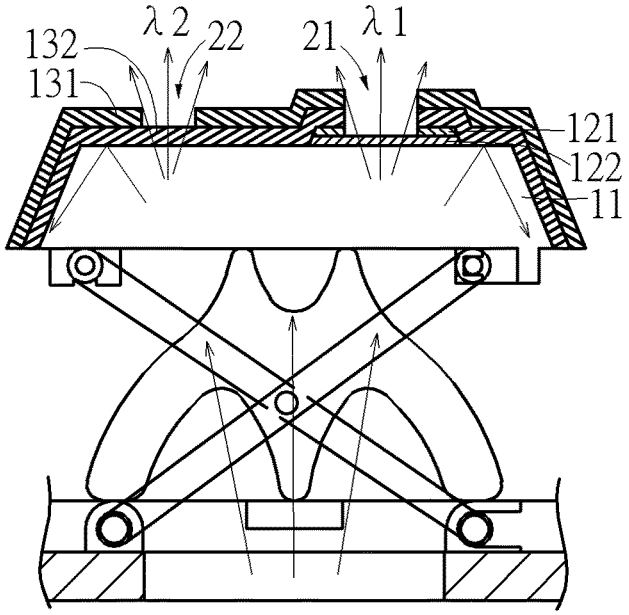
FIG. 6 is a diagram of the light-transmissible keycap shown in FIG. 5 with a scissor structure according to the first embodiment of the present invention.

Please refer to FIG. 5 and FIG. 6. FIG. 5 is a top view diagram of the light-transmissible keycap according to the first embodiment of the present invention. FIG. 6 is a diagram of the light-transmissible keycap shown in FIG. 5 with a scissor structure according to the first embodiment of the present invention. As shown in FIGS. 5 and 6, the light-transmissible keycap of the present invention includes a light-transmissible keycap body 11, first light-transmissible color layer 122, a first dark color layer 121, a second light-transmissible color layer 131, and a second dark color layer 132.

Figure 2A:
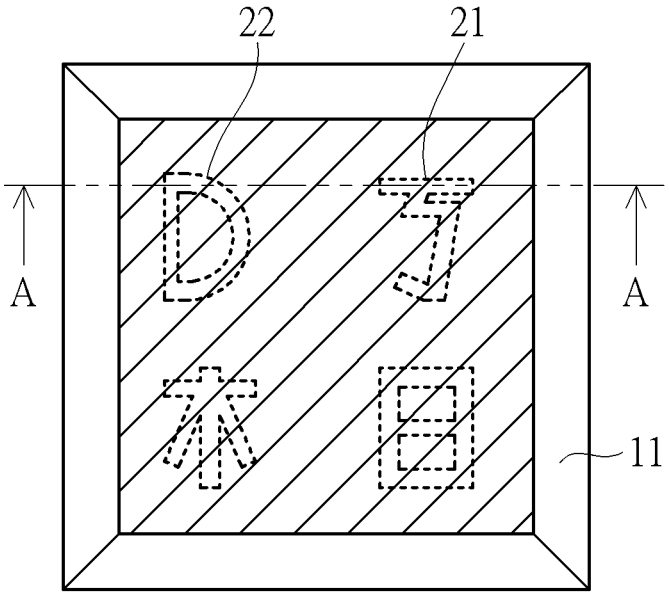
FIG. 2A is a top view diagram of a light-transmissible keycap body according to a first embodiment of the present invention.
Figure 3A:
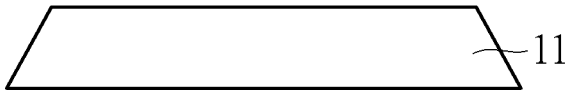
FIG. 3A is a sectional diagram of the light-transmissible keycap body along A-A line shown in FIG. 2A according to the first embodiment of the present invention.

Please refer to FIG. 2A and FIG. 3A. FIG. 2A is a top view diagram of the light-transmissible keycap body 11 according to the first embodiment of the present invention. FIG. 3A is a sectional diagram of the light-transmissible keycap body 11 along A-A line shown in FIG. 2A according to the first embodiment of the present invention. Referring to step S1, FIG. 2A and FIG. 3A, the light-transmissible keycap body 11 includes a first light-transmissible symbol area 21 and a second light-transmissible symbol area 22. The first light-transmissible symbol area 21 includes at least one character corresponding to a first input method. The second light-transmissible symbol area 22 includes at least one character corresponding to a second input method. For example, in this embodiment, the first input method is Chinese input method, and the first light-transmissible symbol area 21 includes three characters, which are "ㄅ", "ㄊ", and "ㄏ" corresponding to Chinese input method. The second input method is English input method, and the second light-transmissible symbol area 22 includes one character, which is "D" corresponding to English input method. Predetermined areas of the characters of the first light-transmissible symbol area 21 and the second light-transmissible symbol area 22 are indicated by dashed lines. It should be noticed that the light-transmissible keycap body 11 can include different characters corresponding to different input methods according to actual requirement, and it is not limited to this embodiment.

Please refer to FIG. 4A to FIG. 4G. FIG. 4A to FIG. 4G are sectional diagrams of the light-transmissible keycap manufactured by the light-transmissible keycap body 11 shown in FIG. 3A in steps of a manufacturing method according to the first embodiment of the present invention. Referring to step S2 shown in FIG. 1 and FIG. 4A, the first light-transmissible color layer 122 can be disposed on the light-transmissible keycap body 11 by pad printing or screen printing. The first light-transmissible color layer 122 covers at least the first predetermined area but does not cover the second predetermined area. Since the first light-transmissible color layer has a first color, when an external light passes through the light-transmissible keycap body 11, the first light-transmissible color layer 122 allows the first light-transmissible symbol area 21 to emit a first color light λ1 with the first color for displaying the character corresponding to the first input method.

Figure 4A:
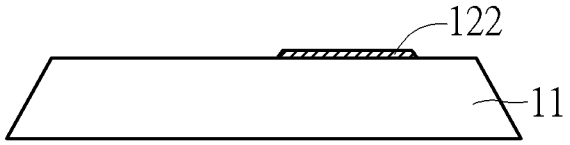
FIG. 4A to FIG. 4G are sectional diagrams of the light-transmissible keycap manufactured by the light-transmissible keycap body shown in FIG. 3A in steps of a manufacturing method according to the first embodiment of the present invention.
Figure 4B:
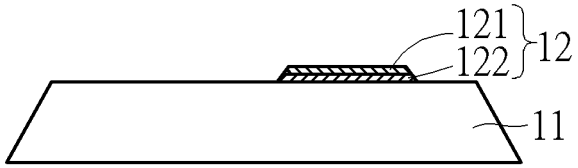

Referring to step S3 shown in FIG. 1 and FIG. 4B, the first dark color layer 121 can be disposed on the first light-transmissible color layer 122 by pad printing or screen printing. The first dark color layer 121 covers at least the first predetermined area but does not cover the second predetermined area. Preferably, the first dark color layer 121 can be made from material in black or deep dark color. It should be noted that the first light-transmissible color layer 122 and the first dark color layer 121 can form a double layer color block 12 integrally in another embodiment Referring to step S4 shown in FIG. 1 and FIG. 4C, the second light-transmissible color layer 132 can be disposed by out mold printing for covering the light-transmissible keycap in above-mentioned step S3, i.e., the second light-transmissible color layer 132 covers the first dark color layer 121 and the second predetermined area. As shown in FIG. 6, since the second light-transmissible color layer has a second color, when the external light passes through the light-transmissible keycap body 11, the second light-transmissible color layer 132 allows the second light-transmissible symbol area 22 to emit a second color light λ2 with the second color for displaying the character corresponding to the second input method. It should be noticed that the first color is different from the second color, such that the first color light λ1 is different from the second color light λ2.

Figure 4C:
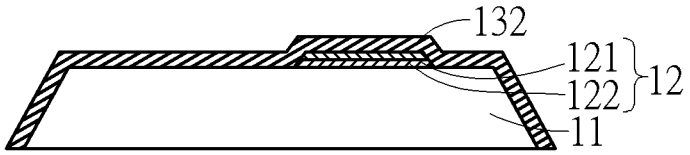
Figure 4D:
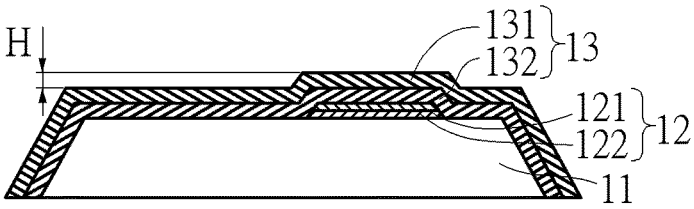

Referring to step S5 shown in FIG. 1 and FIG. 4D, the second dark color layer 131 can be disposed by out mold printing for covering the light-transmissible keycap in the above-mentioned step S4, i.e., the second dark color layer 131 covers the second light-transmissible color layer 132. Preferably, the second dark color layer 131 can be made from material in black or deep dark color. It should be noticed that, in another embodiment, the second light-transmissible color layer 132 and the second dark color layer 131 can be provided by a double layer covering film 13. The double layer covering film 13 can be disposed by out mold decoration (OMD) for covering the light-transmissible keycap body 11 and the first dark color layer 121. In such a way, step S4 and step S5 can be integrated into one single step.

Figure 4E:
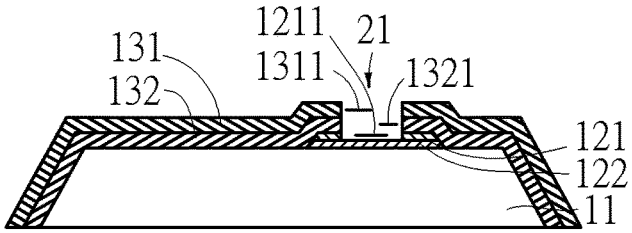

Referring to step S6 shown in FIG. 1 and FIG. 4E, part of the second dark color layer 131, part of the second light-transmissible color layer 132, and part of the first dark color layer 121 corresponding to the first predetermined area are removed by laser caving, so as to form a third hollow pattern 1311 on the second dark color layer 131, a second hollow pattern 1321 on the second light-transmissible color layer 132, and a first hollow pattern 1211 on the first dark color layer 121. The first hollow pattern 1211 and the second hollow pattern 1321 and the third hollow pattern 1311 are communicated with one another, so as to expose the first light-transmissible color layer 122 through the first hollow pattern 1211, the second hollow pattern 1321, and the third hollow pattern 1311 and to form the first light-transmissible symbol area 21 indicated by a solid line and shown in FIG. 5. As shown in FIG. 6, when the external light passes through the light-transmissible keycap body 11 from a bottom side of the light-transmissible keycap body 11, the first light-transmissible color layer 122 allows the first light-transmissible symbol area 21 to emit the first color light λ1. The first color light λ1 with the first color is defined by the first light-transmissible color layer 122 with the first color and not affected by the second light-transmissible color layer 132 with the second color. It should be noticed that during the above-mentioned laser caving process, the second dark color layer 131 and the first dark color layer 121 absorb laser energy to burn out. Therefore, the second light-transmissible color layer 132 above the first dark color layer 121 is removed, and the first light-transmissible color layer 122 beneath the first dark color layer 121 is retained accordingly.

Figure 4F:
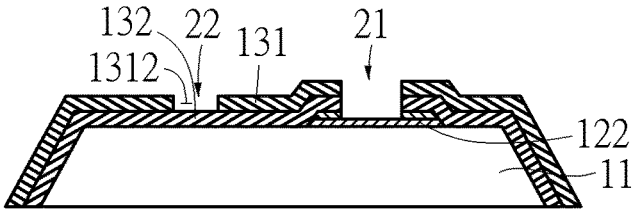
Figure 4G:
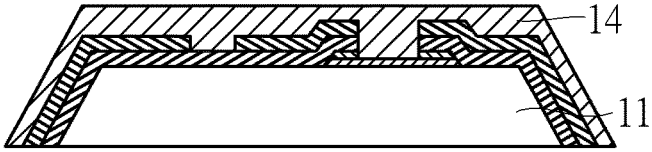

Referring to step S7 shown in FIG. 1 and FIG. 4F, part of the second dark color layer 131 corresponding to the second predetermined area is removed by laser caving to form a fourth hollow pattern 1312 on the second dark color layer 131, so as to expose the second light-transmissible color layer 132 through the fourth hollow pattern 1312 and to form the second light-transmissible symbol area 22 indicated by a solid line and shown in FIG. 5. As shown in FIG. 6, when the external light passes through the second light-transmissible symbol area 22 on the light-transmissible keycap body 11 from the bottom side of the light-transmissible keycap body 11, the light passes through the second light-transmissible color layer 132 only, such that the second light-transmissible symbol area 22 emits the second color light λ2 different from the first color light λ1. The second color light λ2 with the second color is defined by the second light-transmissible color layer 132 with the second color and not affected by the color the first light-transmissible color layer 122 with the first color. It should be noticed that during the above-mentioned laser caving process, the second dark color layer 131 absorbs the laser energy to burn out, but the second light-transmissible color layer 132 is retained.

Furthermore, in this embodiment, the manufacturing method of the light-transmissible keycap can further include a step of utilizing a protecting film 14 for covering at least the double layer covering film 13 after the first light-transmissible color layer 122 is exposed to form the first light-transmissible symbol area 21 (step S6), and the second light-transmissible color layer 132 is exposed to form the second light-transmissible symbol area 22 (step S7). The protecting film 14 covers at least the double layer covering film 13 for protecting the double layer covering film 13.

However, as shown in FIG. 4D, since the double layer color block 12 is disposed on the first light-transmissible symbol area 21 only instead of an entire top surface of the light-transmissible keycap body 11, a protruding height H is formed on a top surface of the second dark color layer 131, which affects aesthetics of the light-transmissible keycap. Therefore, the present invention provides two structural designs of the light-transmissible keycap to solve the above-mentioned drawbacks.

Figure 2B:
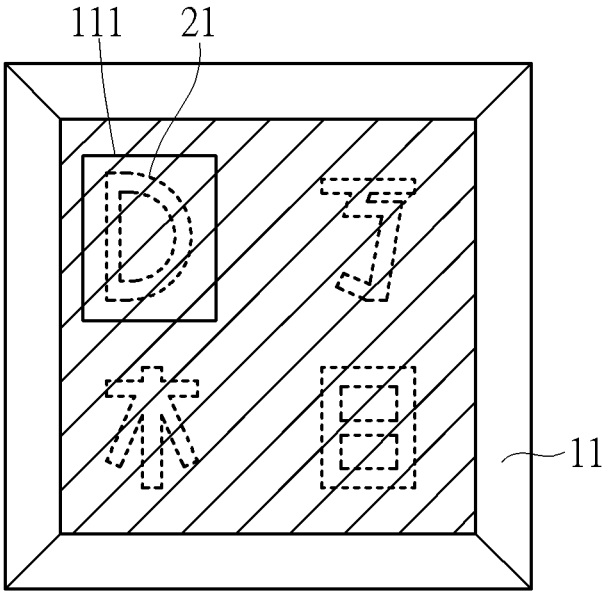
FIG. 2B is a top view diagram of a light-transmissible keycap body according to a second embodiment of the present invention.
Figure 2C:
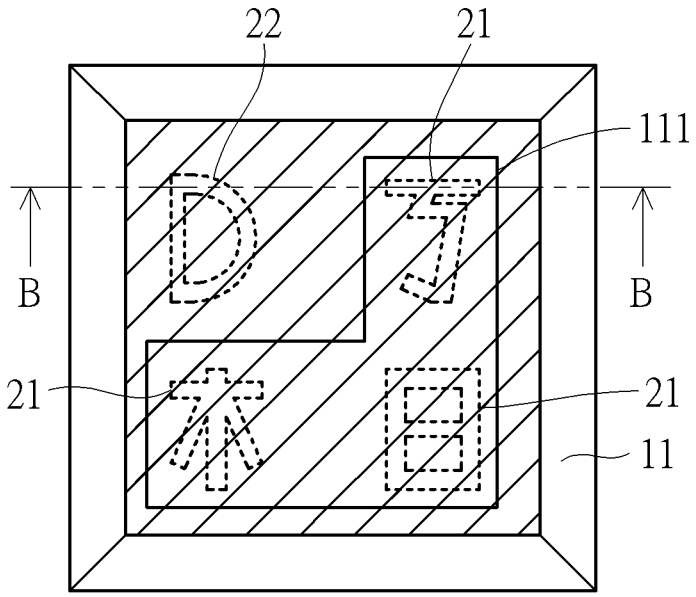
FIG. 2C is a top view diagram of a light-transmissible keycap body according to a third embodiment of the present invention.
Figure 3B:
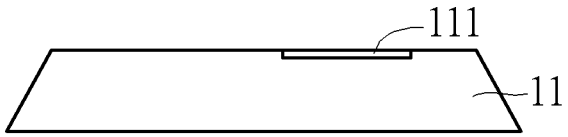
FIG. 3B is a sectional diagram of the light-transmissible keycap body along B-B line shown in FIG. 2C according to the third embodiment of the present invention.

The first structural design is described as follows. Please refer to FIG. 2C and FIG. 3B. FIG. 2C is a top view diagram of the light-transmissible keycap body 11 according to a third embodiment of the present invention. FIG. 3B is a sectional diagram of the light-transmissible keycap body 11 along B-B line shown in FIG. 2C according to the third embodiment of the present invention. As shown in FIG. 2C and FIG. 3C, a slot 111 is formed on the light-transmissible keycap body 11 and corresponding to a predetermined area of the double layer color block 12. A depth of the slot 111 compensates a part of height of the double layer color block 12, which reduces the protruding height of the second dark color layer 131 caused by the double layer color block 12, i.e., a protruding height of the first light-transmissible color layer 122 relative to the top surface of the light-transmissible keycap body 11 is reduced. In this embodiment, the slot 111 can be formed on the predetermined area of the first light-transmissible symbol area 21, which includes characters of "ㄅ", "ㄨ", and "ㄩ" corresponding to Chinese input method, on the light-transmissible keycap body 11. Please refer to FIG. 2B. FIG. 2B is a top view diagram of the light-transmissible keycap body 11 according to a second embodiment of the present invention. In this embodiment, the first light-transmissible symbol area includes a character of "D" corresponding to English input method. Therefore, the slot 111 can be formed on the predetermined area of the first light-transmissible symbol area, which includes the character of "D" corresponding to English input method, on the light-transmissible keycap body 11.

The second structural design is described as follows. As shown in FIG. 4B to FIG. 4D, a cross section of the double layer color block 12 can be substantially formed in a trapezoid shape. A long side of the trapezoid shape is closed to the light-transmissible keycap body 11. Two inclined sides of the trapezoid shape guide the second dark color layer 131 to extend toward a periphery of the double layer color block 12 obliquely and downwardly. In other words, apart of the double layer color block 12 protruding from the top surface of the light-transmissible keycap body 11 is substantially a cubic protruding block. Each of four side surfaces of the cubic protruding block extends outwardly to form a mild inclined surface, and a height of the mild inclined surface is gradually reduced, such that a cross section of the cubic protruding block is gradually increased from top to bottom. In such a way, the light-transmissible keycap of the present invention looks like a tower-shaped base with a flat top surface and four inclined side surfaces. Slopes of the four inclined side surfaces can be constant or gradually reduced.

The protruding height of the top surface of the second dark color 131 is reduced by the first structural design. The protruding height of the top surface of the second dark color 131 is visually hidden by the inclined surfaces of the second structural design. Therefore, it is not easy for users to observe the protruding height of the second dark color layer 131 caused by the double layer color block 12 visually, which improves aesthetics of the light-transmissible keycap of the present invention.

Figure 7:
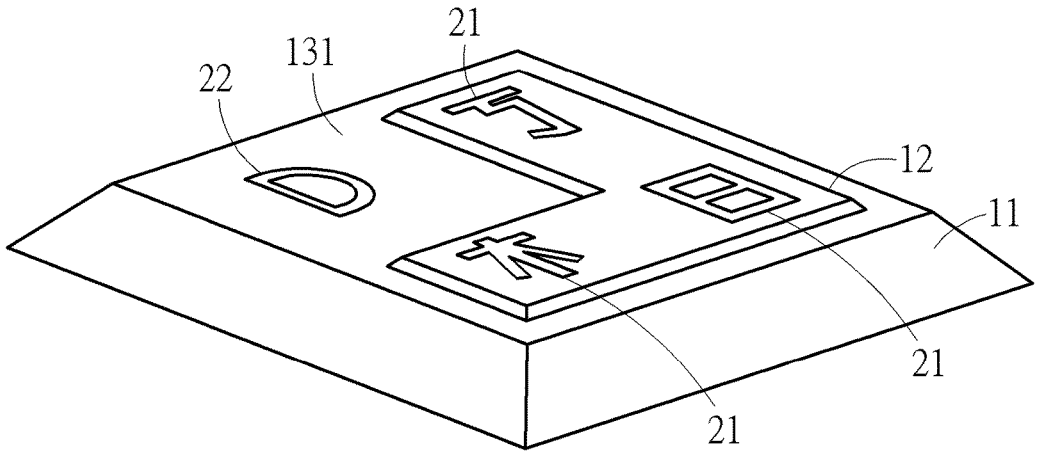
FIG. 7 is a perspective diagram of the light-transmissible keycap according to the first embodiment of the present invention.
Figure 8:
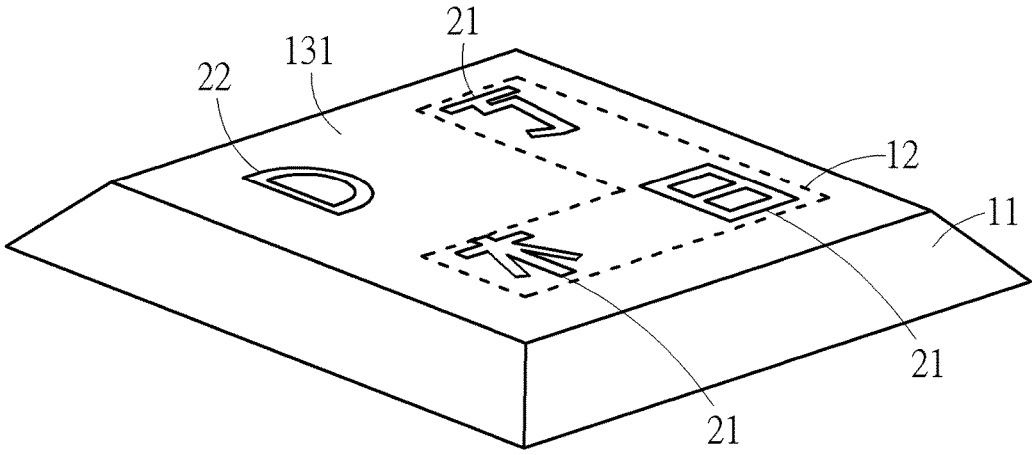
FIG. 8 is a perspective diagram of the light-transmissible keycap according to another embodiment of the present invention.

Furthermore, please refer to FIG. 7 and FIG. 8. FIG. 7 is a perspective diagram of the light-transmissible keycap according to the first embodiment of the present invention. FIG. 8 is a perspective diagram of the light-transmissible keycap according to another embodiment of the present invention. It should be noticed that a thickness of the double layer color block 12 is exaggerated in the figures of the present invention for easily identifying where the double layer color block 12 is and emphasizing the protruding height of the second dark color layer 131 caused by the double layer color block 12, such as shown in FIG. 7. However, actually, the thickness of the double layer color block 12 is much thinner than the one shown in the figures. Furthermore, when the light-transmissible keycap is with the two above-mentioned structural designs, the exterior appearance of the top surface of the light-transmissible keycap is flat visually, as shown in FIG. 8. In other words, the protruding height of the top surface of the second dark color layer 131, which is shown in FIG. 8, is not too obvious, comparing with the one shown in FIG. 7.

In contrast to the prior art, when light passes through the light-transmissible keycap of the present invention, the different light-transmissible symbol areas corresponding to different input methods display different colors, such that it is easy for users to identify the appropriate symbols or characters corresponding to the input methods. Furthermore, when the light passes through the light-transmissible keycap, the light will pass through the different light-transmissible color layers individually, and the light passing through the light-transmissible color layer will not be affected by other light travelling from other light-transmissible color layers. Therefore, the colors corresponding to the different light-transmissible symbol areas are regular, which solves the bleeding problem of the light-transmissible keycap in the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A manufacturing method for a light-transmissible keycap, the light-transmissible keycap comprising a first light-transmissible symbol area and a second light-transmissible symbol area, the manufacturing method comprising:

providing a light-transmissible keycap body, the light-transmissible keycap body having a first predetermined area and a second predetermined area, the first predetermined area enclosing the first light-transmissible symbol area, the second predetermined area enclosing the second light-transmissible symbol area;

disposing a first light-transmissible color layer on the light-transmissible keycap body, the first light-transmissible color layer covering at least the first predetermined area but not covering the second predetermined area, the first light-transmissible color layer having a first color;

disposing a first dark color layer on the first light-transmissible color layer, the first dark color layer covering at least the first predetermined area, but not covering the second predetermined area;

providing a second light-transmissible color layer covering both the first dark color layer and the second predetermined area, the second light-transmissible color layer having a second color, the first color being different from the second color;

providing a second dark color layer covering the second light-transmissible color layer;

removing part of the second dark color layer, part of the second light-transmissible color layer, and part of the first dark color layer to expose part of the first light-transmissible color layer corresponding to the first light-transmissible symbol area, so as to make the first light-transmissible symbol area emit the first color light when an external light passes through the light-transmissible keycap;

removing part of the second dark color layer to expose the second light-transmissible color layer corresponding to the second light-transmissible symbol area, so as to make the second light-transmissible symbol area emit the second color light when the external light passes through the light-transmissible keycap.

2. The manufacturing method of claim 1, wherein disposing the first light-transmissible color layer on the light-transmissible keycap body comprising disposing the first light-transmissible color layer on the light-transmissible keycap body by pad printing or screen printing.

3. The manufacturing method of claim 1, wherein disposing the first dark color layer on the first light-transmissible color layer comprising disposing the first dark color layer on the first light-transmissible color layer by pad printing or screen printing.

4. The manufacturing method of claim 1, wherein the second light-transmissible color layer and the second dark color layer are disposed by out mold decoration.

5. The manufacturing method of claim 1, wherein the second light-transmissible color layer and the second dark color layer are provided by a covering film, and the covering film covers the light-transmissible keycap body and the first dark color layer by out mold decoration.

6. The manufacturing method of claim 5, further comprising:

utilizing a protecting film for covering the covering film after the first light-transmissible color layer is exposed to form the first light-transmissible symbol area, and the second light-transmissible color layer is exposed to form the second light-transmissible symbol area.

7. The manufacturing method of claim 1, wherein the first dark color layer and the second dark color layer are made from material in black or deep dark color.

8. A light-transmissible keycap having a first light-transmissible symbol area and a second light-transmissible symbol area, comprising:

a light-transmissible keycap body, the light-transmissible keycap body having a first predetermined area and a second predetermined area, the first predetermined area enclosing the first light-transmissible symbol area, the second predetermined area enclosing the second light-transmissible symbol area;

a first light-transmissible color layer disposed on the light-transmissible keycap body, the first light-transmissible color layer covering at least the first predetermined area but not covering the second predetermined area, the first light-transmissible color layer having a first color;

a first dark color layer disposed on the first light-transmissible color layer, the first dark color layer covering at least first predetermined area but not covering the second predetermined area, the first dark color layer having a first hollow pattern corresponding to the first light-transmissible symbol area;

a second light-transmissible color layer covering the first dark color layer and the second predetermined area, the second light-transmissible color layer having a second color, the first color being different from the second color, the second light-transmissible color layer having a second hollow pattern corresponding to the first light-transmissible symbol area and communicating with the first hollow pattern; and a second dark color layer covering the second light-transmissible color layer, the second dark color layer having a third hollow pattern corresponding to the first light-transmissible symbol area and communicating with the second hollow pattern, so as to expose an outer surface of the first light-transmissible color layer through the first hollow pattern, the second hollow pattern, and the third hollow pattern, and the second dark color layer having a fourth hollow pattern corresponding to the second light-transmissible symbol area, so as to expose an outer surface of the second light-transmissible color layer through the fourth hollow pattern;

wherein when an external light passes through the light-transmissible keycap, the first light-transmissible symbol area emits a light with the first color, and the second light-transmissible symbol area emits a light with the second color.

9. The light-transmissible keycap of claim 8, wherein a color of the first color light is defined by the color of the first light-transmissible color layer and not related to the color of the second light-transmissible color layer, and a color of the second color light is defined by the color of the second light-transmissible color layer and not related to the color of the first light-transmissible color layer.

10. The light-transmissible keycap of claim 8, wherein the first light-transmissible color layer and the first dark color layer form a double layer color block.

11. The light-transmissible keycap of claim 10, wherein a slot is formed on the light-transmissible keycap body where the double layer color block is disposed for accommodating at least part of the double layer block, so as to reduce a protruding height of the second dark color layer relative to the light-transmissible keycap body caused by the double layer color block.

12. The light-transmissible keycap of claim 10, wherein a cross section of a part of the double layer color block protruding from an outer surface of the light-transmissible keycap body is gradually increased from top to bottom, such that a periphery of the part of the double layer color block protruding from the light-transmissible keycap body has an inclined surface, so as to reduce a protruding height of the second dark color layer relative to the light-transmissible keycap body caused by the double layer color block, and a slope of the inclined surface is constant or gradually reduced.

13. The light-transmissible keycap of claim 10, wherein a cross section of the double layer color block is substantially formed in a trapezoid shape, a long side of the trapezoid shape is close to the light-transmissible keycap body, two inclined sides of the trapezoid shape guide the second dark color layer to extend mildly, so as to hide a protruding height of the second dark color layer relative to the light-transmissible keycap body caused by the double layer color block.

14. The light-transmissible keycap of claim 10, wherein the second light-transmissible color layer and the second dark color layer are provided by a covering film, and the covering film covers the light-transmissible keycap body and the double layer block by out mold decoration.

15. The light-transmissible keycap of claim 14, further comprising a protecting film covering the covering film.

16. The light-transmissible keycap of claim 8, wherein the first dark color layer and the first dark color layer are made from material in black or deep dark color.

17. The light-transmissible keycap of claim 8, wherein the first light-transmissible symbol area displays a first input method symbol via the first light-transmissible color layer, and the second light-transmissible symbol area displays a second input method symbol via the second light-transmissible color layer.

* * * * *